US007024882B2

(12) United States Patent
Carmichael et al.

(10) Patent No.: US 7,024,882 B2
(45) Date of Patent: Apr. 11, 2006

(54) COOLER WITH ORDERED REFILLING

(76) Inventors: William Scott Carmichael, 1426 Highland Ave., Jacksonville, FL (US) 32207; Jeffrey Joseph Tolan, 6357 Smallwood Rd., Jacksonville, FL (US) 32216

( * ) Notice: Subject to any disclaimer, the term of this patent is extended or adjusted under 35 U.S.C. 154(b) by 0 days.

(21) Appl. No.: 10/663,888

(22) Filed: Sep. 16, 2003

(65) Prior Publication Data

US 2005/0056047 A1 Mar. 17, 2005

(51) Int. Cl.
*F25D 3/08* (2006.01)

(52) U.S. Cl. ..... 62/457.5; 220/592.03; 221/150 R

(58) Field of Classification Search ..... 62/371, 62/372, 389, 440, 398, 457.1, 457.5, 458–464; 220/501, 505, 592.03, 592.16; 221/67, 150 R
See application file for complete search history.

(56) References Cited

U.S. PATENT DOCUMENTS 1,023,116 A 4/1912 Bailey
1,240,321 A 9/1917 Dickinson
1,369,440 A * 2/1921 Jones ..... 221/97
1,614,017 A * 1/1927 Nuhrah et al. ..... 312/36
1,689,054 A 10/1928 Samuels
2,538,780 A 1/1951 Hazard
4,194,647 A * 3/1980 Spurrier ..... 221/97
4,499,998 A * 2/1985 Carlson ..... 206/541
4,509,587 A * 4/1985 Clark et al. ..... 165/61
4,510,770 A * 4/1985 Vella ..... 62/464
4,676,074 A * 6/1987 Morgan et al. ..... 62/277
4,852,767 A * 8/1989 Humphrey ..... 221/241
4,899,904 A * 2/1990 Dooley et al. ..... 220/592.16
4,974,426 A * 12/1990 Gomez et al. ..... 62/457.7
5,247,798 A * 9/1993 Collard, Jr. ..... 62/3.62
5,295,369 A 3/1994 Garcia
5,509,279 A 4/1996 Brown et al.
5,535,883 A * 7/1996 Henderson ..... 206/427
5,915,551 A * 6/1999 Vavro ..... 206/315.5
6,109,059 A * 8/2000 Lebrun ..... 62/457.5
6,173,582 B1 1/2001 Hixson
6,536,228 B1 * 3/2003 Hall ..... 62/457.2
6,862,896 B1 * 3/2005 Seidl ..... 62/457.4

* cited by examiner

*Primary Examiner*—William E. Tapolcai
(74) *Attorney, Agent, or Firm*—Thomas C. Saitta

(57) ABSTRACT

An ice chest or cooler having a vertically oriented chute to receive beverage containers such that when the cooler is being refilled the beverage containers are directed through an opening in the bottom of the chute, into the bottom of the main compartment containing the ice and chilled water, and beneath any beverage containers already present in the main compartment.

26 Claims, 3 Drawing Sheets

COOLER WITH ORDERED REFILLING

BACKGROUND OF THE INVENTION

This invention relates generally to the field of coolers or ice chests, i.e., generally rectangular containers with liquid-impermeable, insulated walls and having a hinged or removable top lid, typically portable, into which items to be cooled or chilled, such as cans or bottles, are deposited along with a large quantity of ice. More particularly, the invention relates to any such coolers having a controlled or ordered loading procedure.

Coolers used in chilling and maintaining at reduced temperature beverage containers such as bottles or cans are well known. Originally composed of insulated metal walls, most are now composed of plastic. Large stationary coolers may be found in retail establishments. Portable coolers are even more common for use in transporting bottles or cans of beverages to be consumed at chilled temperatures. In the most common scenario, a large number of cans or bottles are placed into the interior of the cooler and a large amount of relatively small ice cubes or crushed ice is then placed on top of the containers. As the heat is drawn from the cans or bottles by the ice, the ice melts to create a slurry of chilled water and ice surrounding the beverage containers. As the cooler is well insulated and provided with a lid, the melting process occurs slowly and little heat is drawn from outside the cooler, such that the beverage containers will remain chilled for long periods of time. Individual beverage containers are removed by simply reaching into the chilled water and ice mixture.

Because the quantity of beverage containers able to be chilled at any one time is limited by the size of the cooler, circumstances often arise, such as at a party, where it is desirable to restock or replenish the cooler with unchilled cans or bottles for cooling prior to all of the chilled containers having been removed, in order to insure that a continuous quantity of chilled containers will always be available for consumption. In usual practice, when most of the chilled beverage containers have been removed and there remains a large amount of cold water and ice, the unchilled containers are merely dumped or placed into the cooler when refilling. With this technique, the chilled containers may be forced to the bottom of the cooler by the addition of the unchilled containers, resulting in the need to reach deeply into the chilled water to obtain a chilled can or bottle. In addition, the unchilled containers and chilled containers will be randomly mixed after a few such removals from the bottom, such that it is difficult to distinguish a chilled container from an unchilled container and obtaining a chilled container becomes a matter of trial and error.

There are known apparatuses where beverage containers are loaded and dispensed in ordered fashion, such that chilled containers are dispensed prior to unchilled containers, the primary example of which are the well known soft drink vending machines. In these machines, vertical or serpentine gravity-fed chutes are provided to control the dispensing order of the chilled containers, with the cans or bottles being added to the top of the line of containers already in the chute and the bottom-most container being the container dispensed to the buyer. Examples of small, mechanically refrigerated apparatuses for chilling and dispensing beverage containers are illustrated in the 1987 patent to Morgan, Jr. et al. (U.S. Pat. No. 4,676,074) and the 1993 patent to Collard, Jr. (U.S. Pat. No. 5,247,798). In these devices, a top-loading chute is used to order the containers, with the chilled containers being individually dispensed from the lower end of the chute through a gating mechanism positioned in the wall of the cooler. In these apparatuses cooling is accomplished by chilled air. The structural design of these apparatuses is not applicable without modification to an apparatus utilizing melted ice to cool the containers, since dispensing the chilled container from the bottom of the stack or line must take into account the need to prevent melted water from flowing through the dispenser opening.

An early patent to Dickinson, U.S. Pat. No. 1,240,321 issued in 1917, shows an ice-cooled vending machine where the bottles are top-loaded into a chute that delivers the bottles in a line along the slanted bottom of the chest portion of the apparatus and through the chilled water that has melted from a large ice block suspended above the line of bottles. The chilled bottle at the end of the line abuts a wall, and an elevator mechanism is used to raise the bottle from the ice water and direct it into a dispensing chute for delivery to the buyer. Obviously such a complicated mechanical construction is not suitable for portable coolers for a number of reasons, the required elevator mechanism adding unnecessary expense and weight, reducing the volume available to receive the containers, and presenting maintenance issues.

For portable coolers utilizing melted ice as the cooling medium, attempts to solve the ordered dispensing problem focus on separating the ice from the chute retaining the beverage containers. One or more segregated ice compartments are provided and the chute is passed next to, above, below or between one or more walls defining the ice compartment or compartments. This construction does allow for a gravity-fed, top-loading chute with a lower dispensing gate, since the container chute is separated from the melted ice. Examples of such devices are shown in U.S. Pat. No. 1,023,116 issued in 1912 to Bailey, U.S. Pat. No. 1,369,440 issued in 1921 to Jones, U.S. Pat. No. 1,689,054 issued in 1928 to Samuels, U.S. Pat. No. 4,510,770 issued in 1985 to Vella, U.S. Pat. No. 4,899,904 issued in 1990 to Dooley et al., and U.S. Pat. No. 6,173,582 issued in 2001 to Hixson. These constructions limit the amount of ice which can be used and lengthen the chilling time required to attain the desired temperature for the beverage containers because the efficiency of thermal transfer between the ice and the containers is reduced by the separating walls. These devices also reduce the overall capacity of the cooler to the number of beverage containers that can be retained within the chute. Placing a large quantity of ice and chilled water directly against and surrounding the containers to be cooled is a much more efficient method of bringing the unchilled containers to the desired temperature.

It is an object of this invention to provide a construction for a cooler or ice chest which addresses the restocking problem spoken to above, such that the cooler may be restocked in an ordered manner whereby the unchilled containers are directed to the bottom of the cooler beneath any chilled containers remaining in the cooler, such that the chilled containers remain disposed near the top of the cooler for easy access and ordered removal. It is a further object to provide such a cooler whose construction is not dramatically altered from the standard constructions of coolers as produced today, such that access to the interior of the cooler and to the beverage containers is still accomplished by simple movement or removal of a lid. It is a further object to provide such a cooler where the mechanism for accomplishing the ordered restocking of the cooler is relatively simple, and where powered or mechanical assemblies of moving parts are not required to accomplish ordered restocking. It is a further object to provide such a cooler where the ordering mechanism can be added to existing coolers. These and other objects will become apparent upon examination of the disclosure to follow.

SUMMARY OF THE INVENTION

The invention is a cooler, ice chest or functionally similar device, wherein beverage containers such as cans, bottles or the like are retained along with a quantity of ice in order to chill the containers and maintain the chilled containers at temperatures below ambient, wherein the beverage containers and the ice, and the subsequent chilled water resulting from the melting of the ice, are maintained in a common compartment, such that the ice and chilled water comes into direct contact with the beverage containers to maximize thermal transfer. The cooler is constructed from any suitable material with good insulation characteristics, such as plastic, and in the most common embodiment generally comprises a substantially rectangular, four-sided, bottomed, main body with a large open top that is sealed by a hinged or removable lid.

The cooler further comprises a reloading chute preferably defined by the combination of one of the cooler side walls and an internal divider wall disposed generally vertically within the interior of the cooler a short distance from the cooler side wall. The top of the divider wall is approximately even with the top of the cooler wall while the bottom of the divider wall is separated by several inches from the cooler bottom. The distance from the divider wall to the adjacent cooler wall is preferably only slightly larger than the diameter of typical beverage cans or bottles, such that the chute maintains plural beverage containers disposed therein in a relatively straight and generally vertical single file line. The distance from the bottom of the divider wall to the cooler bottom is likewise only slightly larger than the diameter of typical beverage cans or bottles, such that the cans or bottles may roll or pass through the opening beneath the divider wall and into the large main compartment area of the cooler.

Directional ramp members having sloped or concave curved surfaces are positioned at the junction between the bottom and the cooler wall defining the chute, and preferably at the junction between the opposing cooler wall and bottom. In this manner the lowermost cans or bottles in the chute are diverted by gravity or manual force through the opening beneath the divider wall, across the cooler bottom, and up the opposing cooler wall.

The divider wall may be permanently or removably installed either longitudinally or laterally in the cooler main body. The ramp members may be affixed to the interior of the cooler, or the ramp members may be created during manufacture as integral components of the cooler wall and bottom junction. A third directional ramp member may be positioned above the lower directional ramp member on the opposing wall, such that beverage containers are diverted back toward the center of the cooler. A horizontal shelf may be provided above the row of containers on the cooler bottom. The divider wall and the shelf may be apertured or slotted to allow for easier passage of chilled water. When a removable divider wall is utilized, a storage slot may be provided in the cooler lid for storage of the divider wall when not in use.

DETAILED DESCRIPTION OF THE INVENTION

Figure 1:
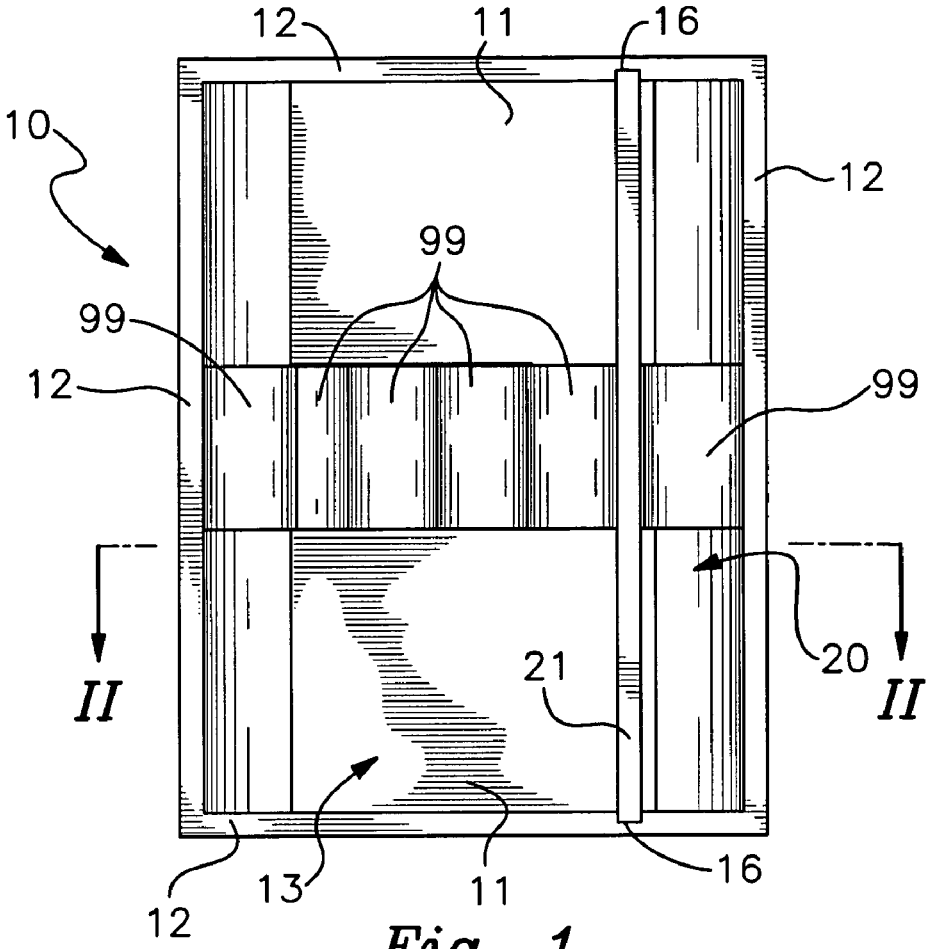
FIG. 1 is a top view of the invention, showing only a single row of beverage containers and the lid removed for clarity.

With reference to the drawings, the invention will now be described in detail with regard for the best mode and the preferred embodiment. While the invention is primarily illustrated as a portable cooler, it is to be understood that the construction is equally applicable to a fixed or stationary cooler of similar construction. As used herein, the term "cooler" shall be taken to encompass ice chests, chillers or other named devices of similar construction and function, wherein the cooling of beverage containers is accomplished using ice rather than mechanical refrigeration. Beverage containers shall mean herein containers that are circular in cross-section, such as cans or bottles, whereby the containers will roll along a surface.

The cooler 10 is a receptacle capable of retaining liquids and is typically composed of a plastic material having good insulation characteristics, or of metal with added insulation material disposed internally in the walls. The main body of the cooler 10 comprises a bottom 11 and four upstanding walls 12 joined to define a generally rectangular interior with a large open top 13. A lid 14 mates with the open top 13 to close the interior. The lid 14 may be hingedly joined to one of the walls 12 or may be completely removable.

Figure 2:
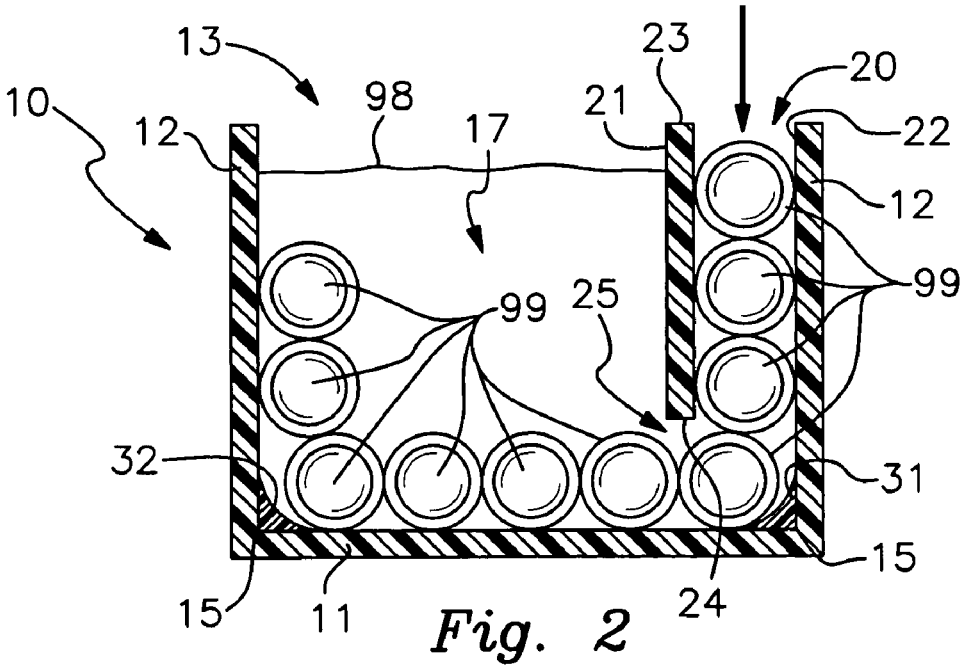
FIG. 2 is a cross-sectional side view of the cooler taken along line II—II of FIG. 1, illustrating curved directional ramp members.
Figure 3:
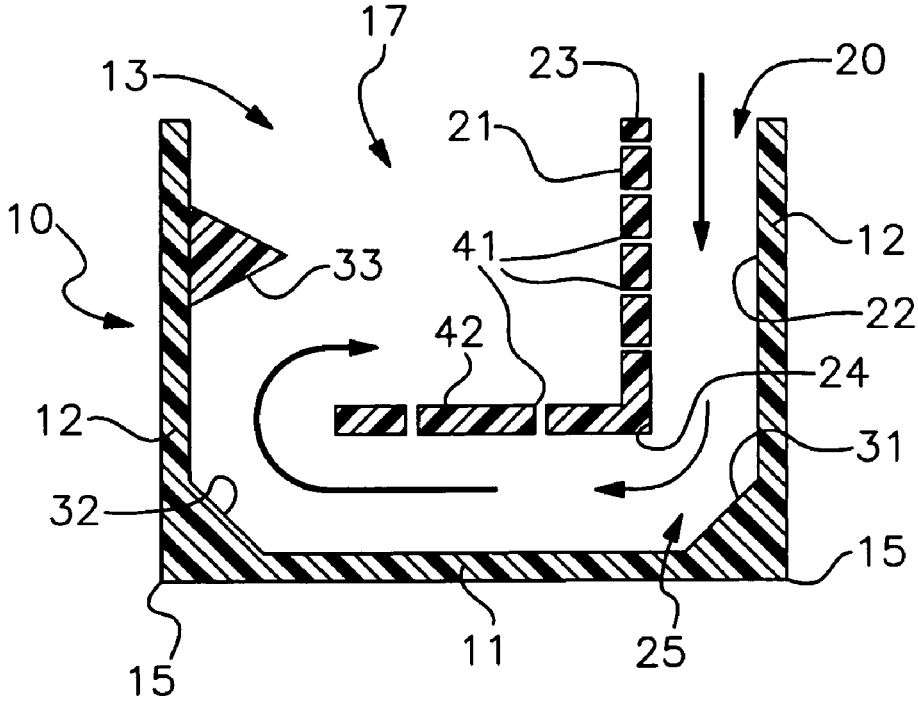
FIG. 3 is a cross-sectional view similar to FIG. 2, but illustrating an alternative embodiment wherein the divider wall is apertured and provided with a suspended horizontal shelf.
Figure 5:
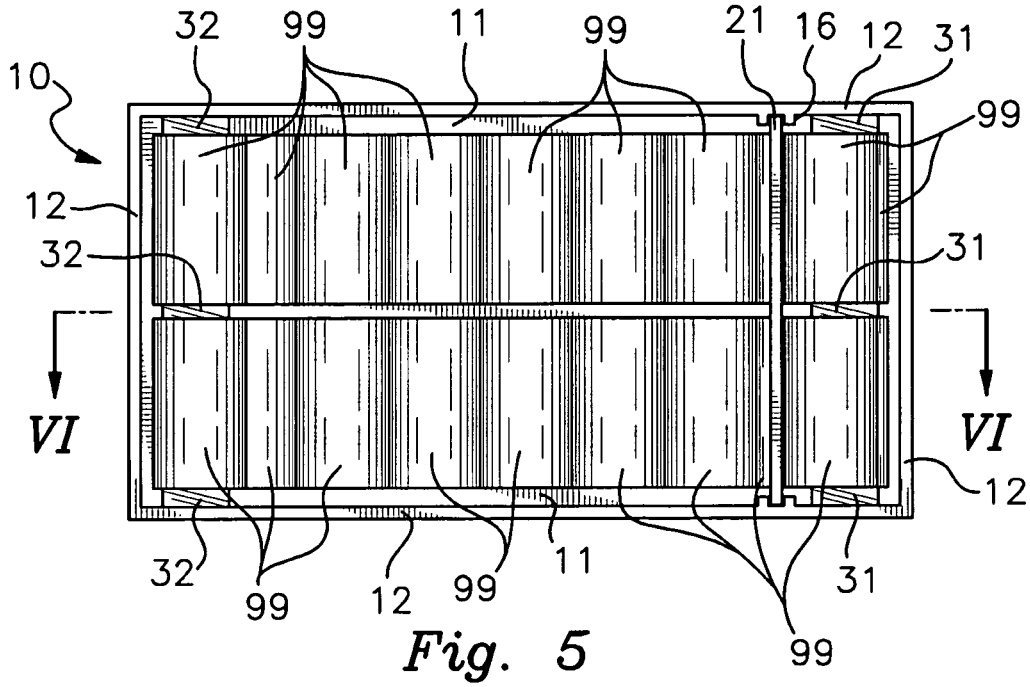
FIG. 5 is a top view of an alternative embodiment wherein the rows of beverage containers extend in the longitudinal direction.
Figure 6:
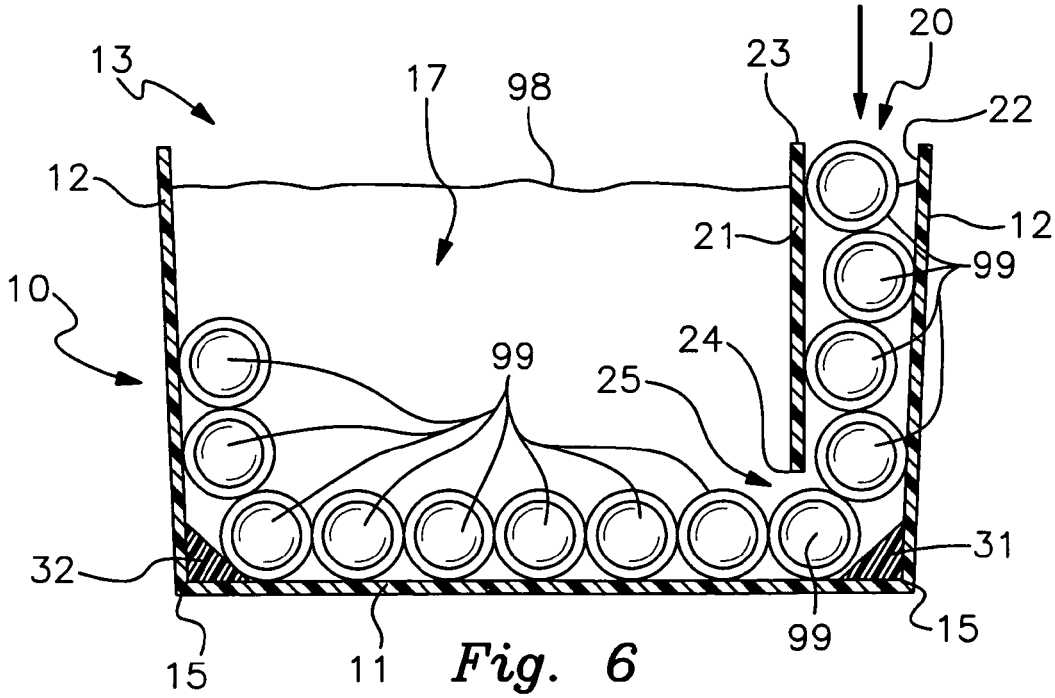
FIG. 6 is a cross-sectional side view of the cooler taken along line VI—VI of FIG. 5, illustrating beveled directional ramp members.

An upstanding, internal divider wall 21 is disposed to extend between two opposing walls 12, either longitudinally as shown in FIGS. 1 through 3 or laterally as shown in FIGS. 5 and 6, and is separated a short distance from one of the remaining walls 12 in a generally parallel manner. The divider wall 21 has a top edge 23 preferably positioned equal to or slightly below the top edge of the walls 12. The divider wall 21 has a bottom edge 24 positioned a distance above the cooler bottom 11 slightly greater than the diameter of standard beverage containers 99, e.g., approximately three inches or more, thereby defining an opening 25 through which beverage containers 99 may slide or roll in a generally horizontal direction. The divider wall 21 may be apertured or slotted such that chilled water may readily pass, with the apertures 41 preferably sized to prevent passage of ice cubes or large ice particles through the divider wall 21. The divider wall 21 may be permanently joined to the walls 12, or divider wall retaining means 16 such as vertical guide slots, shown in FIG. 1, or retaining brackets, shown in FIG. 5, may be provided such that the divider wall 21 can be removed from the cooler 10 when desired.

The combination of the divider wall 21 and the adjacent chute wall 22 formed by the interior of one of the cooler walls 12 defines a restocking or reloading chute 20, the width of the chute 20 being slightly greater than the diameter of standard beverage containers 99, e.g., approximately three inches. In this manner plural beverage containers 99 can be stacked vertically within chute 20, the containers 99 being placed on their sides in a generally single file or linear alignment with the central axes of the containers 99 disposed horizontally.

A directional chute ramp member 31 is positioned at the junction 15 of the wall 12 and the cooler bottom 11. The chute ramp member 31 may have a planar surface, as shown for example in FIGS. 3 and 6, or a concave curved surface, as shown for example in FIG. 2, or may have any other configuration which acts in a manner to prevent beverage containers 99 from being trapped at the junction 15. The chute ramp member 31 may be an integral or molded component of the cooler 10, as shown in FIG. 3, or may be a structure affixed permanently or temporarily to the cooler 10, as shown in FIGS. 2 and 6. The chute ramp member 31 directs or diverts the lowermost container 99 in the chute 20 in the horizontal direction across the cooler bottom 11, such that the lowermost container 99 rolls or slides through the opening 25 beneath the divider wall 21 and into the main cooling compartment 17.

Most preferably, an opposing ramp member 32 is positioned at the junction 15 between the bottom 11 and the opposing wall 12 across from the chute 20. The opposing ramp member 32 may have a planar surface, as shown for example in FIGS. 3 and 6, or a concave curved surface, as shown for example in FIG. 2, or may have any other configuration which acts in a manner to prevent beverage containers 99 from being trapped at the junction 15. The opposing ramp member 32 may be an integral or molded component of the cooler 10, as shown in FIG. 3, or may be a structure affixed permanently or temporarily to the cooler 10. The opposing ramp member 32 directs or diverts the most forward container 99 in the horizontal row on the cooler bottom 11 upward in the vertical direction along the opposing side wall 12, such that the forward containers 99 move upward and into a more central location within the interior of the cooler 10 as the row of containers 99 is advanced.

Thus, when the cooler 10 containing ice and melted water 98 is to be restocked with unchilled containers 99, the containers 99 are dropped or pushed into the top of chute 20. The addition of each container 99, whether through gravity effects or by manually pushing down on the vertical stack of containers 99, causes the lowermost container 99 to pass through the opening 25 beneath divider wall 21. Any chilled containers 99 already present in the interior of the cooler 10 will be pushed forward across the cooler bottom 11 by the newly added unchilled containers 99. The presence of the ice and ice water 98 and other chilled containers 99 causes the containers 99 along the bottom 11 to remain compacted or abutted as the row is advanced, such that as new containers 99 are added, they will remain submerged below any chilled containers 99 already present in the cooler 10. Only when the number of unchilled containers 99 is sufficient to push the forward containers 99 onto the opposing ramp member 32 do any of the containers 99 in the horizontal row rise into the main cooling compartment 17 of the cooler 10, thus insuring that the sufficiently chilled containers 99 are constantly disposed nearest the open top 13 of the cooler 10. The residence time for each container 99 within the cooler 10 diminishes in the direction opposite to the loading direction, i.e., from the opposing ramp member 32 to the chute ramp member 31 and up the chute 20, such that the warmest containers 99 will always reside in the chute 20 itself and not be subject to accidental withdrawal from the cooler 10. As all of the containers 99 along the bottom 11 are removed, gravity effects will cause the containers 99 remaining in the chute to slide or roll out of the chute 20 through opening 25, where they will be accessible from the main cooling compartment 17.

In an alternative embodiment, as shown in FIG. 3, a reversing ramp member 33 may be provided on the interior of the opposing side wall 12 a short distance above the opposing ramp member 32. This reversing ramp member 33 diverts the rising containers 99 back toward the divider wall 21 and onto the lower row of containers 99, or if present, onto a suspended shelf 42. The shelf 42 extends from the bottom edge 24 and lower opening 25 of the chute 20 across the main cooling compartment 17 a short distance above the cooler bottom 11. Apertures 41 may be provided in the shelf 42 to allow for better transfer of chilled water onto the horizontal row of containers 99.

Figure 4:
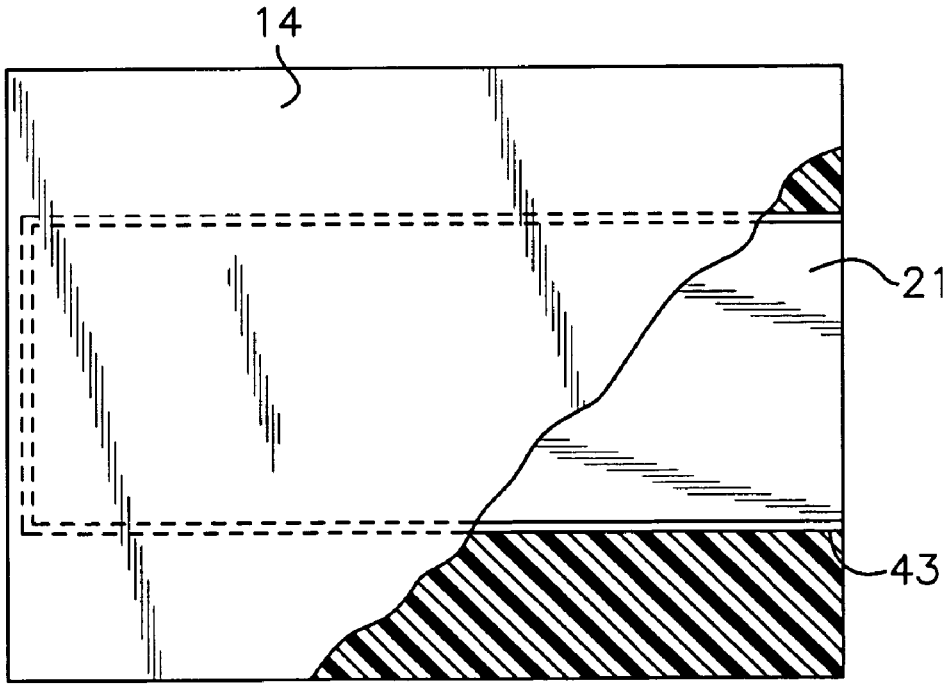
FIG. 4 is a partially exposed view of a cooler lid illustrating the divider wall disposed within a storage slot.

In another alternative embodiment, wherein the divider wall 21 is removable from the side walls 12, the cooler lid 14 may be provided with a storage slot 43 sized to receive and retain the divider wall 21, as shown in FIG. 4.

It is understood that equivalents and substitutions for certain elements set forth and described above may be obvious to those skilled in the art, and thus the true scope and definition of the invention is to be as set forth in the following claims.

We claim:

1. In a cooler for beverage containers wherein the beverage containers are chilled by direct contact with ice and ice water, said cooler having walls and a bottom defining in combination a main cooling compartment accessible through an open top and sized to retain multiple beverage containers along said bottom, the improvement comprising:

a generally vertically oriented chute sized to receive horizontally disposed beverage containers in a generally vertical stack, said chute having a lower opening providing ingress into said main cooling compartment; and a stationary chute ramp member positioned within said chute, said chute ramp member directing said lowermost beverage container horizontally through said opening along said bottom and into said main cooling compartment.

2. The cooler of claim 1, the improvement further comprising an opposing stationary ramp member positioned across said bottom opposite said stationary chute ramp member, said opposing stationary ramp member directing said beverage containers vertically within said main cooling compartment.

3. The cooler of claim 1, wherein said chute is defined by a divider wall positioned between two opposing walls of said cooler and adjacent a remaining wall of said cooler.

4. The cooler of claim 3, wherein said divider wall is removable.

5. The cooler of claim 4, the improvement further comprising retaining means on said two opposing walls of said cooler to retain said divider wall.

6. The cooler of claim 5, wherein said retaining means comprise slots in said two opposing walls of said cooler.

7. The cooler of claim 5, wherein said retaining means comprise brackets on said two opposing walls of said cooler.

8. The cooler of claim 1, wherein said stationary chute ramp member is removable from said cooler.

9. The cooler of claim 2, wherein said stationary chute ramp member and said stationary opposing ramp member are removable from said cooler.

10. The cooler of claim 1, wherein said chute is defined by a divider wall positioned between two opposing walls of said cooler and adjacent a remaining wall of said cooler, and wherein said divider wall and said stationary chute ramp member are removable from said cooler.

11. The cooler of claim 2, wherein said chute is defined by a divider wall positioned between two opposing walls of said cooler and adjacent a remaining wall of said cooler, and wherein said divider wall, said stationary chute ramp member and said opposing stationary ramp member are removable from said cooler.

12. The cooler of claim 4, wherein said cooler further comprises a lid member, and the improvement further comprises a slot disposed within said lid member sized to receive said divider wall for storage.

13. The cooler of claim 2, the improvement further comprising a shelf extending from said lower opening of said chute and across said bottom of said cooler.

14. The cooler of claim 13, the improvement further comprising a reversing ramp member positioned on a wall of said cooler above said opposing ramp member, whereby said beverage cans are diverted onto said shelf.

15. The cooler of claim 3, the improvement further comprising apertures positioned in said divider wall.

16. A cooler for beverage containers wherein beverage containers are chilled by direct contact with ice and ice water, said cooler comprising in combination:

four walls, a bottom, an open top, and a lid adapted to cover said open top and define a main cooling compartment;

a divider wall extending between two opposing walls of said four walls and positioned generally parallel to another of said walls, said divider wall having a bottom edge spaced from said bottom to define a lower opening, whereby the combination of said divider wall and said another of said walls defines a chute adapted to receive beverage containers aligned in a generally vertical stack; and a stationary chute ramp member positioned at the junction of said bottom and said another of said walls, whereby said stationary chute ramp member directs the lowermost of said beverage containers disposed in said chute horizontally through said lower opening and into said main cooling compartment.

17. The cooler of claim 16, further comprising an opposing stationary ramp member at the junction of said bottom and one of said side walls opposite from said stationary chute ramp member, whereby said opposing stationary ramp member directs said beverage containers in the vertical direction.

18. The cooler of claim 16, wherein said divider wall is removable.

19. The cooler of claim 18, wherein said stationary chute ramp member is removable.

20. The cooler of claim 17, wherein said divider wall is removable.

21. The cooler of claim 20, wherein said stationary chute ramp member and said opposing stationary ramp member are removable.

22. The cooler of claim 16, further comprising apertures positioned in said divider wall.

23. The cooler of claim 18, further comprising retainer means positioned on said two opposing walls to retain said divider wall.

24. The cooler of claim 23, wherein said retainer means comprises slots positioned on said two opposing walls.

25. The cooler of claim 23, wherein said retainer means comprises brackets positioned on said two opposing walls.

26. The cooler of claim 18, further comprising a slot disposed within said lid, said slot adapted to receive said divider wall for storage.

* * * * *